United States Patent [19]

Yamaguchi et al.

[11] 3,983,932

[45] Oct. 5, 1976

[54] HEAT EXCHANGER

[75] Inventors: Terumoto Yamaguchi; Yoshinao Amano, both of Anjo; Kunio Suzuki, Kariya; Toshihiro Kobayashi, Gamagori, all of Japan

[73] Assignee: Nippondenso Co., Ltd., Japan

[22] Filed: Apr. 30, 1975

[21] Appl. No.: 573,152

[30] Foreign Application Priority Data

May 10, 1974 Japan ..... 49-52709

[52] U.S. Cl. ..... 165/154; 29/157.3 A

[51] Int. Cl.[2] ..... F28F 13/02

[58] Field of Search ..... 165/153, 160, 170, 154, 165/155, 169, 166; 113/118 R, 118 D

[56] References Cited

UNITED STATES PATENTS

| | | | |
|---|---|---|---|
| 2,133,502 | 10/1938 | Emmond | 165/153 |
| 2,803,440 | 8/1957 | Simbelaar | 165/160 |
| 2,990,163 | 6/1961 | Farrell | 165/154 |
| 3,542,124 | 8/1968 | Manfredo | 165/166 |
| 3,543,844 | 12/1970 | Jordan | 165/155 |
| 3,739,843 | 6/1973 | Huberski | 165/170 |

*Primary Examiner*—Charles J. Myhre
*Assistant Examiner*—Theophil W. Streule, Jr.
*Attorney, Agent, or Firm*—Cushman, Darby & Cushman

[57] ABSTRACT

A heat exchanger includes wall members forming a fluid passage therebetween and an inner fin formed of a sheet metal and disposed therein. The inner fin is formed with a plurality of corrugated projections whose side portions are twisted at a certain angle in a plane parallel to the sheet metal with respect to a direction transverse to a fluid flow.

2 Claims, 5 Drawing Figures

HEAT EXCHANGER

BACKGROUND OF THE INVENTION

1. Field of the Invention

The present invention relates to a heat exchanger and more particularly to a structure which may be utilized for the water cooling of oil, as for example, in connection with the cooling of oil in a torque converter for a motor vehicle.

2. Description of Prior Art

In a conventional heat exchanger of this kind such as exemplified in U.S. Pat. No. 2,752,128, a turbulator formed from a flat-metal-sheet is disposed in an annular passageway formed by an inner and outer concentric tube. The turbulator is characterized by longitudinally aligned groups of parallel slits defining staggered trapezoidally-shaped portions offset from the plane of the metal-sheet. The material between each pair of adjacent slits in a group is positioned at opposite sides of the plane of the metal-sheet to form the trapezoidally-shaped portions.

In another conventional heat exchanger of this kind such as exemplified in U.S. Pat. No. 3,083,662, a turbulizer has a base and a plurality of longitudinally spaced groups of substantially trapezoidally shaped corrugations extending in one direction from the plane of the base. These groups extend transversely of the flat stock during formation and radially from the base when the turbulizer is formed into a circular configuration. Each of groups includes a series of spaced corrugations and an alternate series of longitudinally offset corrugations.

In these conventional heat exchangers, the flow therethrough is retarded by the turbulator or the turbulizer to increase turbulence and enhance the efficiency of heat transfer. However, it has a disadvantage in that heat transfer is diminished because of the fact that a large laminar sublayer is formed behind a side portion of the trapezoidally shaped portion due to the side portion being transverse to a direction of the fluid flow. Because the laminar sublayer of the fluid is of relatively low velosity compared with the normal fluid flow, it offers a high resistance to heat transfer.

SUMMARY OF THE INVENTION

It is, therefore, a primary object of the present invention to provide a heat exchanger being capable of effecting a high degree of turbulence therein, to thereby enhance the efficiency of heat transfer.

Another object of the present invention is to provide an inner fin of the mentioned type which is characterized by radially extending projections protruding from a metal-sheet whose side portions are twisted at a certain angle in a plane parallel to the metal-sheet with respect to a direction transverse to the flow of the oil flowing through the heat exchanger, thus assuring turbulence in the oil during the course of flow through the annular heat exchanger chamber.

Other objects and advantages will be apparent from the following description of preferred embodiments of the present invention with reference to the accompanying drawings.

DESCRIPTION OF THE PREFERRED EMBODIMENTS

Figure 1:
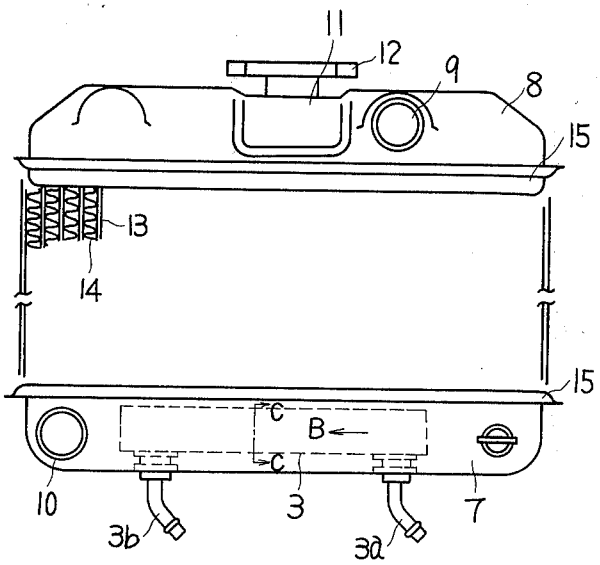
FIG. 1 is a front view of a radiator for a motor vehicle mounting a heat exchanger according to the present invention.
Figure 2:
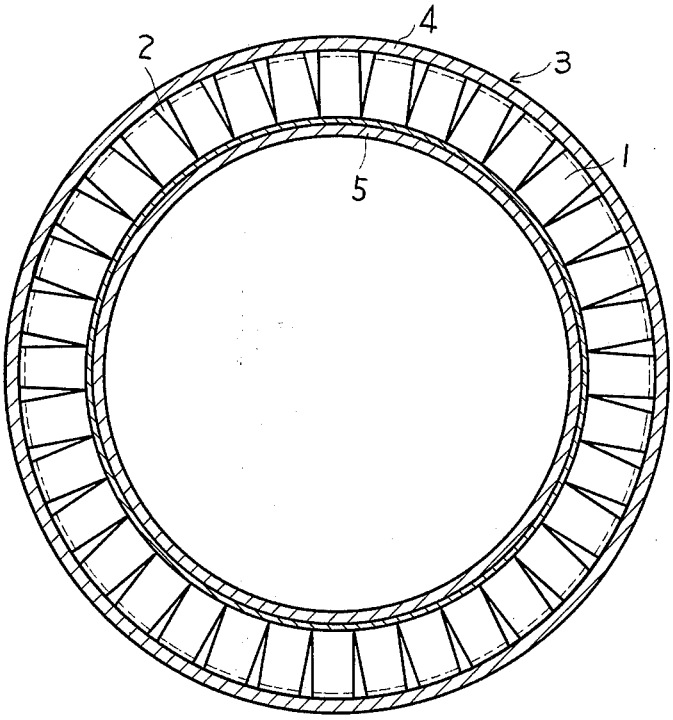
FIG. 2 is an enlarged vertical transverse cross-sectional view taken along a line C—C in FIG. 1 with parts omitted.

Referring to FIGS. 1 and 2, a tubular heat exchanger 3 is disposed in and fixed to, by soldering or the like, a lower tank 7 of a radiator for a motor vehicle and includes an inlet pipe 3*a* and an outlet pipe 3*b* fixed thereto and respectively to be coupled to a torque converter (not shown) or the like. The radiator further includes an upper tank 8 with an inlet 9 for engine-cooling water and a water-pouring pipe 11 sealed by a pressure cap 12, core plates 15 fixed to both sides of tubes 13 and forming the upper and lower tank 8 and 7, and a radiating fin 14 disposed between and fixed to the tubes 13 for transferring heat to the outside from engine-cooling water flowing through the tubes from the upper tank 8 to the lower tank 7. The lower tank 7 is also provided with an outlet 10 to be connected to an engine.

The heat exchanger 3 includes an inner and outer concentric cylindrical tube 5 and 4 forming an annular shaped passageway 2 therebetween, the ends of such passageway being suitably closed. The heat exchanger 3 further includes an inner fin 1 disposed in the passageway 2 comprising a plurality of corrugated projections extending radially and outwardly.

In the heat exchanger 3, the fluid such as engine oil, oil of a torque converter or the like enters into the heat exchanger 3 from the inlet pipe 3*a* and flows through the passageway 2 in a direction designated by an arrow B in FIG. 1, so that the heat is transferred from the fluid to the inner fin 1 and further to the outer tube 4 and the inner tube 5, and then the heat is dissipated in the engine-cooling water flowing in the outside of the outer tube 4 and the inside of the inner tube 5. Thus the fluid flows out from the outlet pipe 3*b* being cooled and returning to the torque converter or the like.

Figure 3:
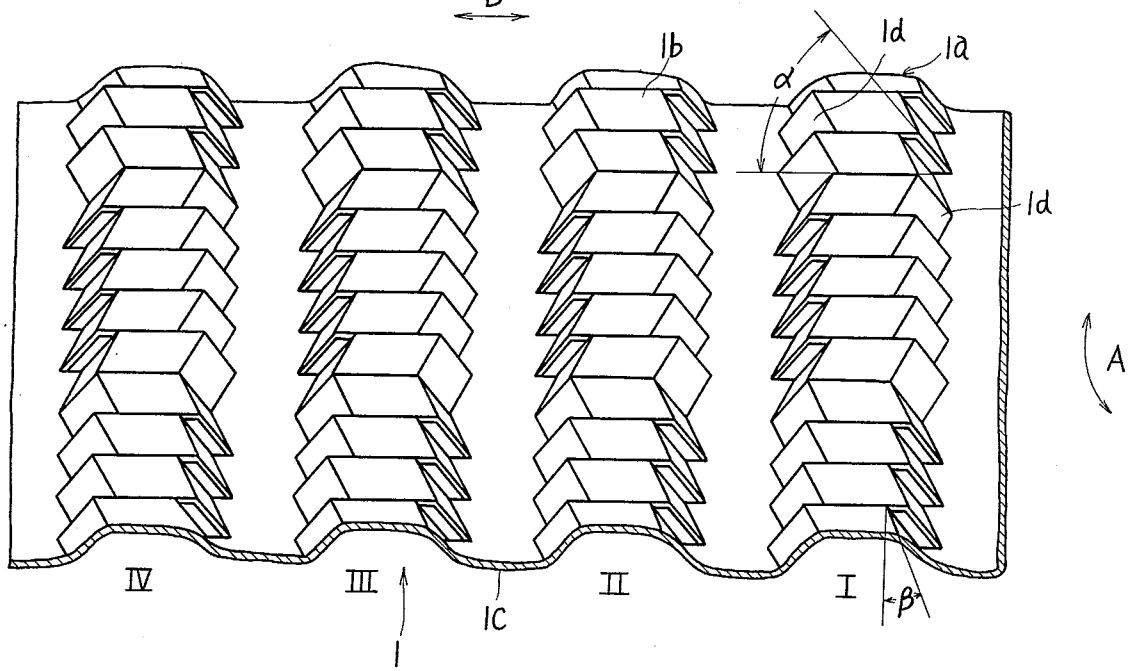
FIG. 3 is a developed perspective view showing one form of an inner fin according to the present invention.

FIG. 3 shows one form of the inner fin 1 according to the present invention, in a developed perspective view, which is made of a flat metal-sheet having a high thermal conductivity such as brass, aluminum or the like. The inner fin 1 is formed by slitting the metal sheet to form groups of parallel slits, each group being positioned on a line extending parallel to the lines of other groups and corresponding slits in each group being aligned. The material between each pair of adjacent slits in a group is protruded from the original plane of the metal sheet to form a corrugated projection, while a base 1*c* remains as a portion of the original sheet. Each of the projections 1*a* comprises a top portion 1*b* and two side portions 1*d*. The side portion 1*d* is inclined at an angle $\alpha$ in a plane transverse to the base 1*c* with respect to a direction of the fluid flow designated by an arrow B in the same manner as the conventional projection. The side portion 1*d* is further twisted at an angle $\beta$ in a plane parallel to the base 1*c* with respect to a direction transverse to the direction B of the fluid flow. For instance, in this embodiment, it is preferably defined that the angle $\alpha$ is about 80° and the twisted angle $\beta$ is about 35°. A plurality of projection groups I, II, III . . . are formed along the lines transverse to the direction of fluid flow, on which the groups of the parallel slits are positioned as described above. Each of the projection groups I, II, III . . . comprises a plurality of projection series each of which includes a certain number of projections 1*a* (five projections in this embodiment shown in FIG. 3). Each projection in a projection series has the twisted angle $\beta$ twisted in the same one direction while each projection in an adjacent projection series has the twisted angle $\beta$ twisted in another same direction which is symmetrical with respect to the direction B of the fluid flow with the same one direction. Insertion of the inner fin 1 is carried out by rolling it up in a direction designated by an arrow A, so that the top portions 1*b* of the projections 1*a* face the internal surface of the outer tube 4 and the base 1*c* faces the external surface of the inner tube 5 being disposed in the passageway 2 defined by the outer and inner tube 4 and 5.

Figure 4:
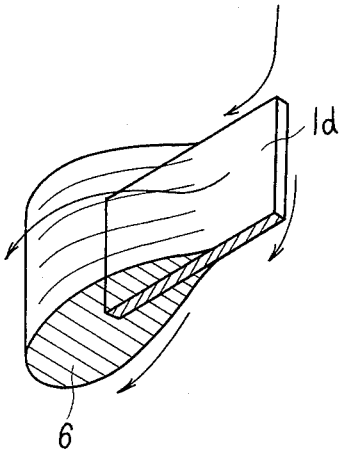
FIG. 4 is a diagram for explaining heat transfer operation of the inner fin and showing a sectional view of one side portion taken along plane parallel to the metal sheet when viewed from above.

Now, heat transfer operation of the heat exchanger 3 according to the present invention as constructed above will be explained. As the side portion 1*d* for absorbing the heat of the fluid is twisted at the angle $\beta$ with respect to the direction transverse to the fluid flow B, the fluid such as the engine-oil flows along both sides of the side portion 1*d* as shown in FIG. 4. As a result, the laminar sublayer 6 formed by the fluid flow over the side portion 1*d* becomes much thinner in comparison with the conventional side portion which is positioned transverse to the fluid flow. Further as the twisted directions of the projection series are alternately reversed, the fluid flows zig-zag to thereby increase the efficiency of turbulence. The increase of the efficiency of turbulence can exfoliate the laminar sublayer 6, so that it can be further made thinner. Thereby the efficiency of heat transfer can be highly enhanced, whereby the amount of transferred heat can be increased.

In the above embodiment, the corrugated projections 1*a* are so explained as extending in one direction, namely from the inner tube 5 to the outer tube 4, and aligned in such a manner that the twisted directions of the projection series are alternately reversed, however, the various modifications can be easily made by those skilled in the art without departing from the scope of the present invention. For example a modification in which the helical-gear-shaped projections 1*a* are alternately positioned at opposite sides of the base for every projections, and the twisted directions of the projections are reversed at random may be made.

Figure 5:
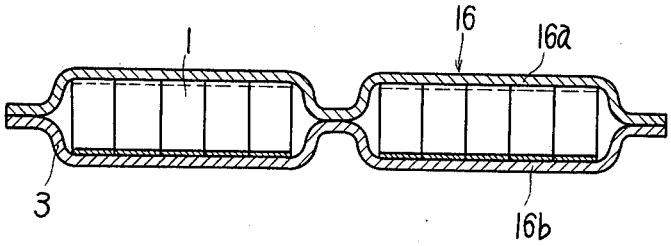
FIG. 5 is a cross-sectional view of another form of a heat exchanger according to the present invention.

The inner fin 1 according to the present invention can be also applied to a flat-type heat exchanger 3 as shown in FIG. 5, in which an upper and lower plate 16*a* and 16*b* form a flat-tube 16 having a passageway and the inner fin 1 is disposed therein.

What we claim is:

1. A heat exchanger comprising:

a first wall member and a second wall member for defining a fluid passage therebetween;

a pair of spaced seal members between said wall members for defining opposite extremities of said fluid passage:

an inlet and outlet pipe for directing a fluid in a stream to, through and from said fluid passage; and an inner fin disposed in said fluid passage and extending in heat transfer engagement with said wall members, said inner fin being formed from sheet material which is slit along groups of parallel slits with such groups being arranged on parallel lines and corresponding slits of different groups being aligned, the material between adjacent slits of a group being disposed out of the plane of said sheet material on one side thereof and arranged in parallel lines to form corrugated projections, the corrugated projections in one group being twisted in the same direction and the corrugated projections in an adjacent group within each parallel line being twisted in the same other direction with adjacent groups of corrugated projections in adjacent parallel line groups being twisted in the same direction.

2. A heat exchanger comprising:

a first wall member and a second wall member for defining a fluid passage therebetween;

a pair of spaced seal members between said wall members for defining opposite extremities of said fluid passage;

an inlet and outlet pipe for directing a fluid in a stream to, through and from said fluid passage; and an inner fin disposed in said fluid passage and extending in heat transfer engagement with said wall members, said inner fin being formed from sheet material which is slit along groups of parallel slits with such groups being arranged on parallel lines and corresponding slits of different groups being aligned, the material between adjacent slits of a group being disposed out of the plane of said sheet material to form corrugated projections, said corrugated projections comprise;

top portions parallel to the plane of said sheet material; and side portions extending from said sheet material and intermediating between said top portions and said sheet material;

each of said side portions being twisted at a certain angle in a plane parallel to said sheet material with respect to said line of said group, said projections extending from the plane of said sheet material in one direction, said projections in each of said groups being comprised of a plurality of projection series, in which each projection in one of said projection series has the twisted angle twisted in the same direction while each projection in an adjacent projection series having the twisted angle twisted in another same direction being symmetrical with respect to an axis transverse to said line with said same one direction.

* * * * *